US009038619B1

(12) United States Patent
Kempf

(10) Patent No.: US 9,038,619 B1
(45) Date of Patent: May 26, 2015

(54) VIBRATION DAMPENED BARREL FOR A CROSSBOW

(71) Applicant: James J. Kempf, Coralville, IA (US)

(72) Inventor: James J. Kempf, Coralville, IA (US)

( * ) Notice: Subject to any disclaimer, the term of this patent is extended or adjusted under 35 U.S.C. 154(b) by 0 days.

(21) Appl. No.: 14/558,005

(22) Filed: Dec. 2, 2014

(51) Int. Cl.

| | |
|---|---|
| ***F41B 5/20*** | (2006.01) |
| ***F41B 5/12*** | (2006.01) |
| ***F41B 5/14*** | (2006.01) |
| *A63B 59/00* | (2006.01) |

(52) U.S. Cl.
CPC ..... *F41B 5/1426* (2013.01); *F41B 5/12* (2013.01); *A63B 59/0092* (2013.01)

(58) Field of Classification Search
CPC ..... F41B 5/1426; F41B 5/123
USPC ..... 124/25, 86, 88, 89; 18/25, 86, 88, 89
See application file for complete search history.

(56) References Cited

U.S. PATENT DOCUMENTS

| | | | | |
|---|---|---|---|---|
| 4,948,131 | A * | 8/1990 | Nakanishi | 473/521 |
| 5,553,596 | A * | 9/1996 | Bednar | 124/25 |
| 5,595,168 | A * | 1/1997 | Martin | 124/89 |
| 5,772,541 | A * | 6/1998 | Buiatti | 473/520 |
| 6,257,220 | B1 * | 7/2001 | McPherson et al. | 124/89 |
| 6,382,201 | B1 * | 5/2002 | McPherson et al. | 124/89 |
| 6,651,641 | B1 * | 11/2003 | Bower et al. | 124/25 |
| 6,758,205 | B2 * | 7/2004 | Kronfeld | 124/89 |
| 7,055,276 | B2 * | 6/2006 | McPherson | 42/1.06 |
| 7,178,514 | B2 * | 2/2007 | Chang | 124/25 |
| 7,455,059 | B2 * | 11/2008 | Shaffer | 124/25 |
| 7,703,449 | B2 * | 4/2010 | Wright | 124/89 |
| 7,938,108 | B2 * | 5/2011 | Popov et al. | 124/25 |
| 8,033,275 | B2 * | 10/2011 | Bednar et al. | 124/25 |
| 8,061,339 | B2 * | 11/2011 | Shaffer | 124/25 |
| 8,141,548 | B2 * | 3/2012 | Leven | 124/89 |
| 8,191,541 | B2 * | 6/2012 | Shaffer et al. | 124/25 |
| 8,225,777 | B2 * | 7/2012 | Chu | 124/25 |
| 8,627,811 | B1 * | 1/2014 | Darlington | 124/25 |
| 8,656,899 | B2 * | 2/2014 | Bednar et al. | 124/25 |
| 8,794,224 | B2 * | 8/2014 | Bednar et al. | 124/25 |
| 2002/0020403 | A1 * | 2/2002 | Troubridge | 124/89 |
| 2003/0159684 | A1 * | 8/2003 | Donovan | 124/89 |
| 2003/0226556 | A1 * | 12/2003 | Leven | 124/89 |
| 2005/0121012 | A1 * | 6/2005 | McPherson | 124/23.1 |
| 2008/0156310 | A1 * | 7/2008 | Leven | 124/89 |
| 2009/0000606 | A1 * | 1/2009 | Cooper et al. | 124/25.6 |
| 2009/0178657 | A1 * | 7/2009 | Shaffer | 124/25 |
| 2012/0006311 | A1 * | 1/2012 | Bednar et al. | 124/25 |
| 2012/0167864 | A1 * | 7/2012 | Sims | 124/86 |

* cited by examiner

*Primary Examiner* — Melba Bumgarner
*Assistant Examiner* — Alexander Niconovich
(74) *Attorney, Agent, or Firm* — Donald J. Ersler

(57) ABSTRACT

A vibration dampened barrel for a crossbow preferably includes at least two vibration dampening chambers, which extend at least a portion of a length of the vibration dampened barrel. The at least two vibration dampening chambers are at least partially filled with a vibration dampening material, such as silicone, rubber, low density foam, high density foam, or any other suitable material that absorbs noise and or vibration. The vibration dampening material is preferably applied by injection, compression, spray, pouring or any other suitable method. The vibration dampening material is retained in the at least two vibration dampening chambers by curing or hardening; mechanically confinement including the use of fasteners or a plug; or with any other suitable method. The at least two vibration dampening chambers may be partially or fully filled. The vibration dampening material may also be placed on a surface inside an extruded barrel.

11 Claims, 5 Drawing Sheets

VIBRATION DAMPENED BARREL FOR A CROSSBOW

BACKGROUND OF THE INVENTION

1. Field of the Invention

The present invention relates generally to archery and more specifically to a vibration dampened barrel for a crossbow, which includes a reduction in vibration and noise in the barrel when the crossbow is discharged.

2. Discussion of the Prior Art

Historically, archery bows and crossbows have been used for war, survival, sport, and recreation. A specific component of a shooting crossbow is the barrel. Various methods are known in the production of crossbow barrels. Crossbow barrels have been fabricated from hollow extrusions, machined billet, injection molding and other methods. A hollow or at least partially hollow barrel is more prone to the vibration associated with the problems that are addressed by the present invention. Prior methods, such as flat rubber pads, elongated rubber capsules, and multiple elongated fingers of rubber have all been used to dampen vibration. While all of these methods work to some extent, all have significant issues with performance and/or assembly and cost.

U.S. Pat. No. 5,553,596 to Bednar discloses a rubber pad positioned between the bow riser and the leading end of the barrel, which is designed to isolate vibration from the riser to the barrel. U.S. Pat. No. 7,178,514 to Chang compresses a resilient element between the bow riser and the forward end of the barrel, also attempting to isolate the riser from the barrel. Though both of these methods work to an extent, they both do little or nothing to control vibration generated within the barrel itself. U.S. Pat. No. 8,656,899 to Bednar uses an insert to dampen shock created by the cable slide as the slide moves, after the discharge of the crossbow. This only works as a partial dampening of vibration caused within the barrel. Due to the inherent design of hollow extrusions, vibration may transmit from anywhere along a length of the barrel. These methods only work to confine vibration from the forward end of the barrel.

Accordingly, there is a clearly felt need in the art to provide a vibration-dampened barrel for a crossbow, which allows vibration control through an entire length of the crossbow barrel. A cross sectional design of the barrel is key to optimizing the vibration dampening control.

SUMMARY OF THE INVENTION

The present invention provides a vibration-dampened barrel for a crossbow, which allows vibration control through an entire length of the crossbow barrel. The crossbow barrel is preferably formed with an extrusion manufacturing process. The vibration-dampened barrel preferably includes at least two vibration-dampening chambers, which extend at least a portion of a length of the vibration-dampened barrel. The at least two vibration dampening chambers are at least partially filled with a vibration dampening material, such as silicone, rubber, low density foam, high density foam, or any other suitable material that absorbs noise and or vibration. The vibration dampening material is preferably applied by injection, compression, spray, pouring or any other suitable method. The vibration dampening material is retained in the at least two vibration dampening chambers by curing or hardening; mechanically confinement including the use of fasteners or a plug; or with any other suitable method. The at least two vibration dampening chambers may be partially or fully filled; and use a singular type of anti-vibration material or at two types of vibration dampening material.

The vibration dampening material may be applied anywhere along a length of the vibration dampening chamber, such as a front, middle, rear or through an entire length thereof. The vibration dampening material may also be placed inside corners of an extruded barrel.

Accordingly, there is a clearly felt need in the art to provide a vibration-dampened barrel for a crossbow, which allows vibration control through an entire length of the crossbow barrel.

These and additional objects, advantages, features and benefits of the present invention will become apparent from the following specification.

DETAILED DESCRIPTION OF THE PREFERRED EMBODIMENTS

Figure 1:
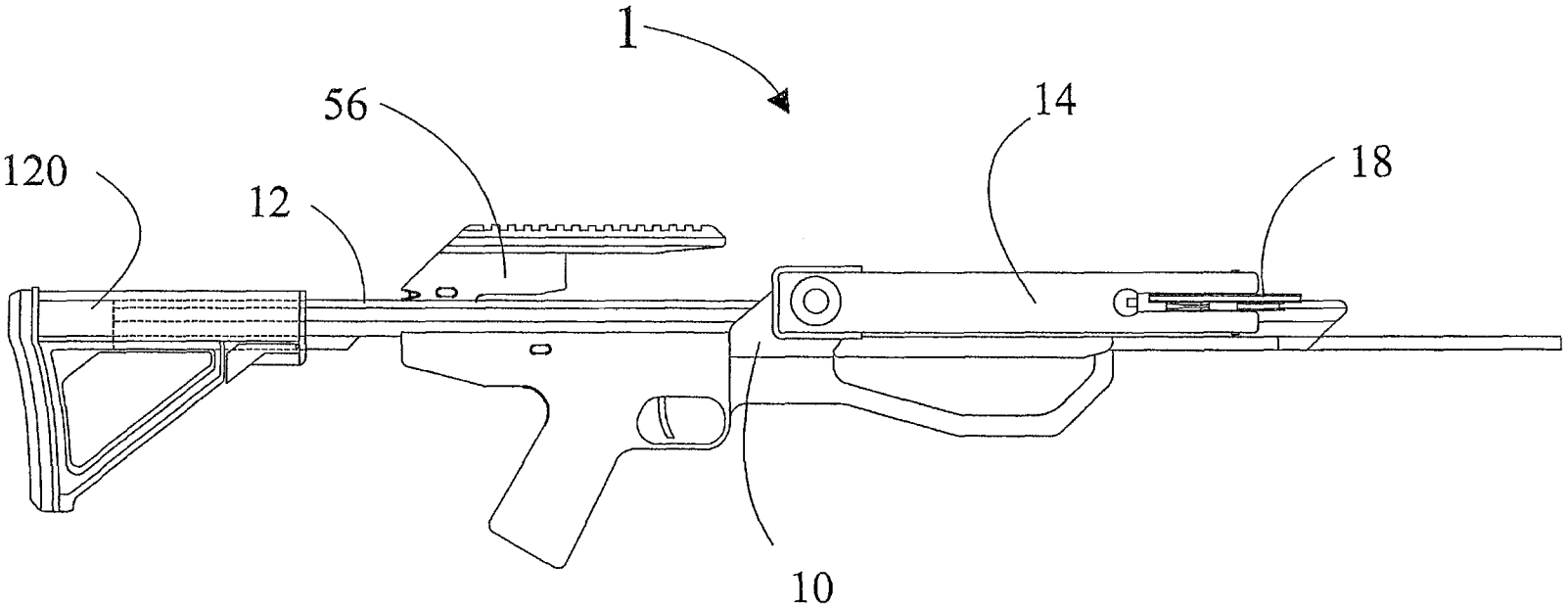
FIG. 1 is a side view of a reverse limb crossbow having a butt stock, a string latch housing, and a bow assembly in accordance with the present invention.
Figure 2:
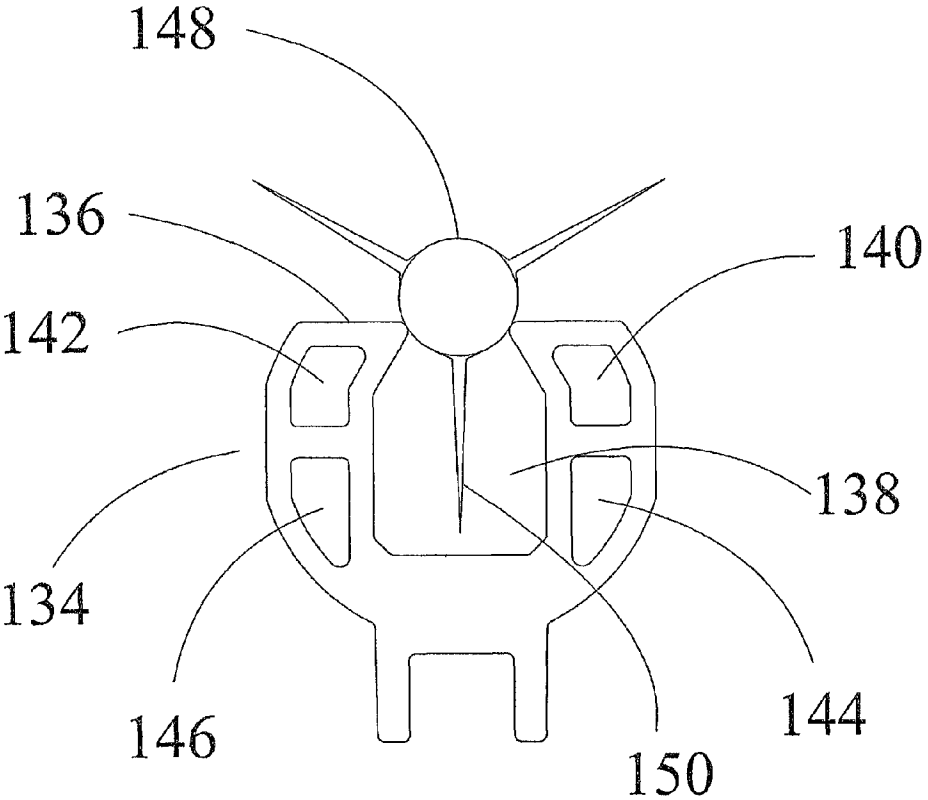
FIG. 2 is an end view of a vibration-dampened barrel having at least four chambers in accordance with the present invention.
Figure 2A:
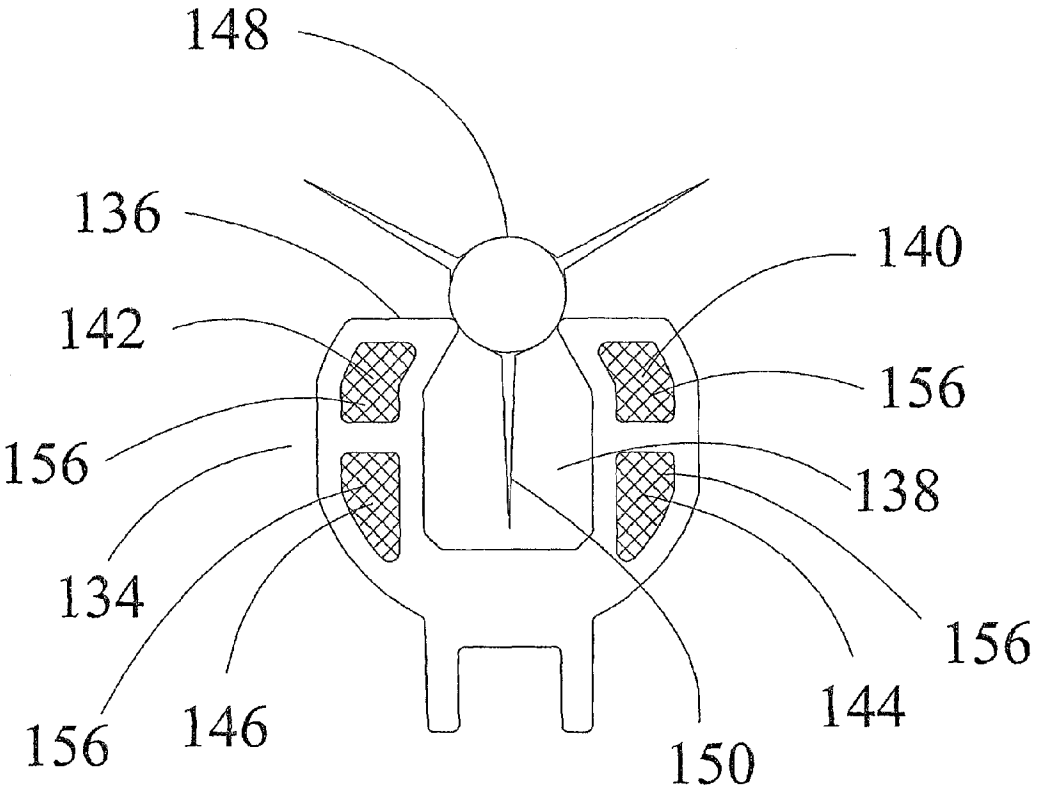
FIG. 2A is an end view of a vibration-dampened barrel having at least four chambers containing a vibration dampening material in accordance with the present invention

With reference now to the drawings, and particularly to FIG. 1, there is shown a side view of a reverse limb crossbow 1. The reverse limb crossbow 1 includes a riser 10; an extruded barrel 12, a vibration dampened barrel 12', 134; two limbs 14; two cams 18; a string latch housing 56; and a butt stock 120. With reference to FIGS. 2-2A, a vibration-dampened barrel 134 preferably includes a flight deck 136, an arrow vane channel 138, and vibration dampening chambers 140, 142, 144, and 146. The vibration dampening chambers 140, 142, 144, and 146 have a length of at least a portion of the vibration-dampened barrel 12'. The vibration dampening chambers 140, 142, 144, and 146 are disposed in opposing sides of the vibration dampened barrel 12'. With reference to FIG. 2A, the vibration dampening chambers 140, 142, 144, 146 are at least partially filled with a vibration absorbing material 156.

Figure 2B:
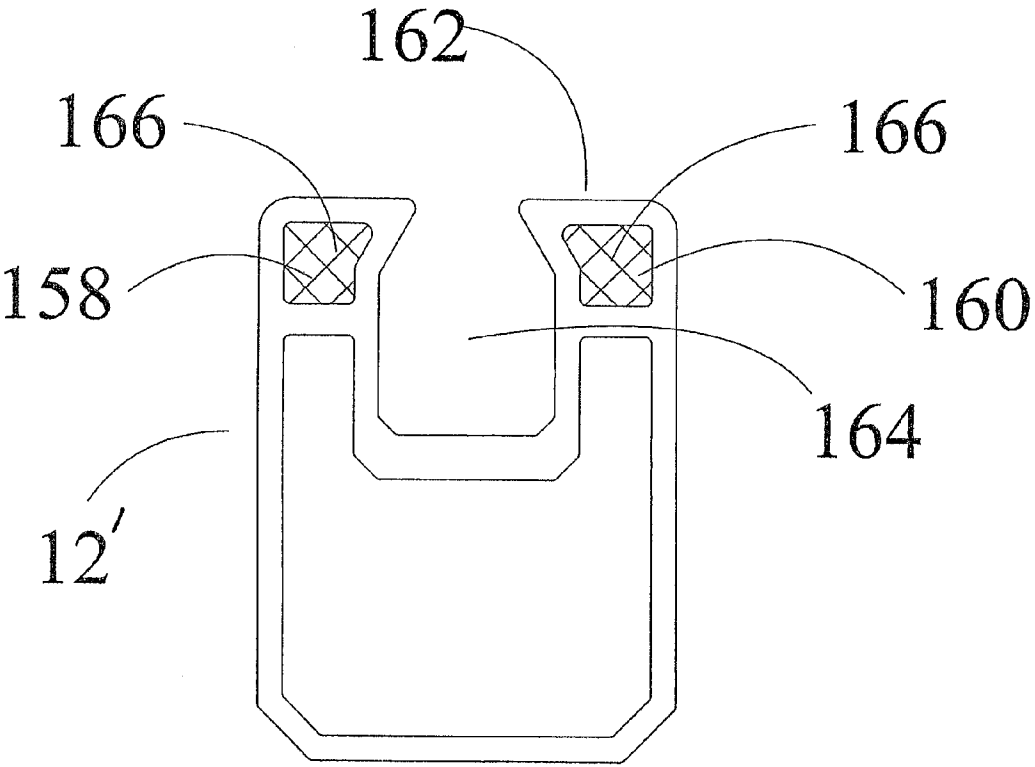
FIG. 2B is an end view of a vibration-dampened barrel having at least two chambers containing a vibration dampening material in accordance with the present invention.
Figure 2C:
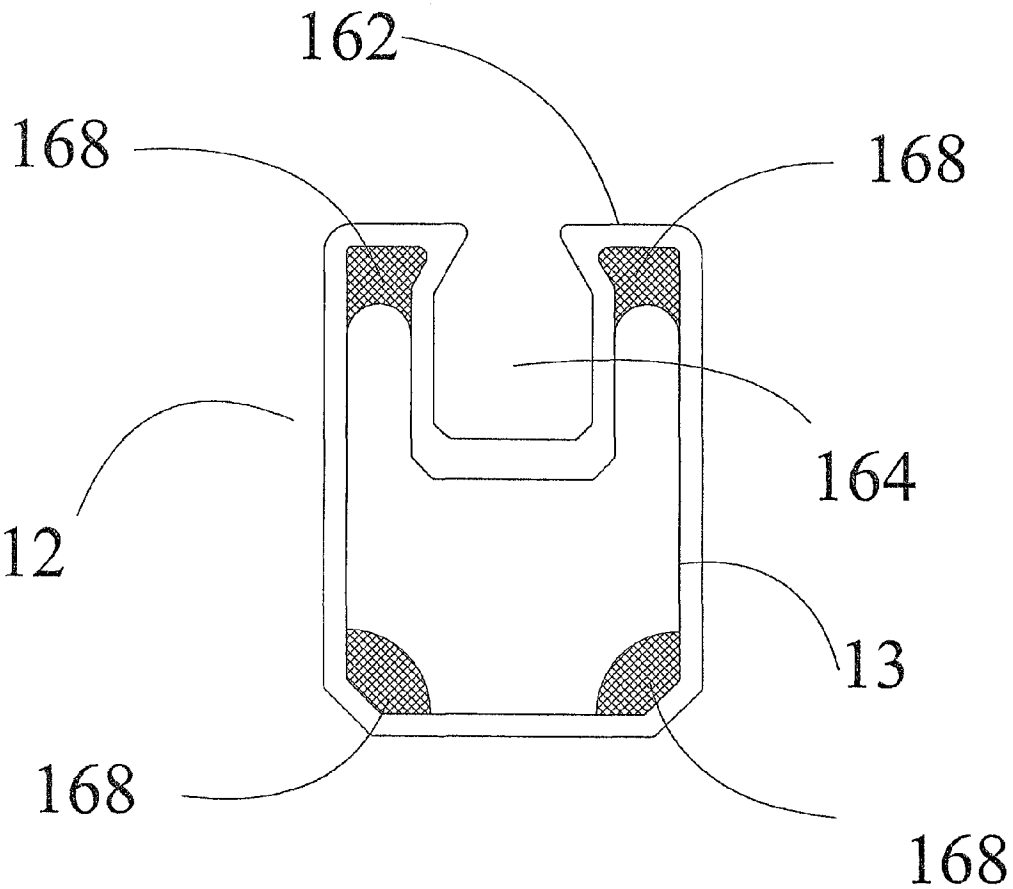
FIG. 2C is an end view of a vibration-dampened barrel having a vibration dampening material applied to inside corners thereof in accordance with the present invention.

With reference to FIG. 2B, opposing vibration dampening chambers 158, 160 are disposed below a flight deck 162 in a vibration dampening barrel 12'. The vibration dampening chambers 158, 160 have a length of at least a portion of the vibration dampened barrel 12'. The vibration dampening barrel 12' preferably includes the flight deck 162 and an arrow vane channel 164. The vibration dampening chambers 158, 160 are at least partially filled with a vibration absorbing material 166. With reference to FIG. 2C, the extruded barrel 12 does not include vibration-dampening chambers.

Vibration absorbing material 168 is preferably on to at least one surface of an inner perimeter 13 of the barrel 12. The vibration absorbing material 168 is applied to at least a portion of a length of the barrel 12.

Typical crossbow barrels are constructed so that a bowstring that arrow rides along the flight deck 136, 162. As the arrow 148 rests on the flight deck 136, 162, typically one of the vanes 150 of the arrow 148 extends downward into the vane channel 138, 162. The application of a vibration dampening material 156, 166, 168 in the barrels 12, 12', 134 reduces unwanted noise and vibration. The vibration dampening material 156, 166, 168 may be a silicone, rubber, low density foam, high density foam, Oobleck, or any other suitable material that absorbs noise and or vibration. Oobleck is a liquid that solidifies as soon as it is struck or senses vibration. The vibration dampening material 156, 166, 168 is preferably applied by injection, compression, spray, pouring or any other suitable method. The vibration dampening material 156, 166, 168 is retained in the at least two vibration dampening chambers and inner perimeter of the barrel 12 by curing or hardening; mechanical confinement, including the use of fasteners or a plug; or with any other suitable method. The at least two vibration dampening chambers 140, 142, 144, 146, 158, 160 may be partially or fully filled with the vibration dampening material 156, 166, 168; and use a singular type of anti-vibration material or at least types of vibration dampening material. The vibration dampening material 156, 166, 168 may be applied anywhere along a length of the vibration dampening chambers 140, 142, 144, 146 or inner perimeter 13, such as a front, middle, rear or through an entire length thereof.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A vibration dampened crossbow comprising:

a barrel having an overall length and at least two vibration dampening chambers, said at least two vibration chambers each extend at least substantially all of said overall length of said barrel, each one of said two vibration dampening chambers includes an enclosed inner perimeter wall; and at least a portion of said at least two vibration dampening chambers are filled with a non-structural vibration absorbing material that when cured remains flexible, wherein noise and vibration are absorbed by said vibration absorbing material.

2. The vibration dampened crossbow of claim 1 wherein:

said vibration absorbing material is at least one of silicone, rubber, low density foam, high density foam and Oobleck.

3. The vibration dampened crossbow of claim 1 wherein:

said barrel is formed by an extrusion manufacturing process.

4. The vibration dampened crossbow of claim 1 wherein:

said vibration absorbing material is applied to said at least two chambers by injection, compression, spray or pouring.

5. A vibration dampened crossbow comprising:

a barrel having a channel formed in a top thereof and an inner perimeter, said barrel having an overall length and at least two vibration dampening chambers, said at least two vibration dampening chambers each are formed in said inner perimeter, said at least two vibration dampening chambers extend at least substantially all of said overall length of said barrel, each one of said two vibration dampening chambers includes an enclosed inner perimeter wall; and at least a portion of said at least two vibration dampening chambers are filled with a non-structural vibration absorbing material that when cured remains flexible, wherein noise and vibration are absorbed by said vibration absorbing material.

6. The vibration dampened crossbow of claim 5 wherein:

said vibration absorbing material is at least one of silicone, rubber, low density foam, high density foam and Oobleck.

7. The vibration dampened crossbow of claim 5 wherein:

said barrel is formed by an extrusion manufacturing process.

8. The vibration dampened crossbow of claim 5 wherein:

said vibration absorbing material is applied to said at least two chambers by injection, compression, spray or pouring.

9. A vibration dampened crossbow comprising:

a barrel having an overall length, a channel and an enclosed inner perimeter, said channel is formed in a top of said barrel, said enclosed inner perimeter extends at least substantially all of said overall length of said barrel; and a non-structural vibration absorbing material is applied to at least a portion of at least one surface in said enclosed inner perimeter the vibration absorbing material when applied to the surface and cured remains flexible, wherein noise and vibration are absorbed by said vibration absorbing material.

10. The vibration dampened crossbow of claim 9 wherein:

said vibration absorbing material is at least one of silicone, rubber, low density foam, high density foam and Oobleck.

11. The vibration dampened crossbow of claim 9 wherein:

said barrel is formed by an extrusion manufacturing process.

* * * * *